United States Patent [19]

Adams et al.

[11] Patent Number: 4,576,570

[45] Date of Patent: Mar. 18, 1986

[54] AUTOMATIC COMBUSTION CONTROL APPARATUS AND METHOD

[75] Inventors: James Adams, Highland Heights; Felix Belin, Mayfield Heights, both of Ohio

[73] Assignee: Republic Steel Corporation, Cleveland, Ohio

[21] Appl. No.: 618,706

[22] Filed: Jun. 8, 1984

[51] Int. Cl.[4] ..... F23N 1/02

[52] U.S. Cl. ..... 431/12; 431/76; 236/15 BD; 236/15 E; 364/510

[58] Field of Search ..... 431/2, 12, 76, 90; 122/448 R; 236/15 BD, 15 E, 14; 364/442, 502, 510; 60/665

[56] References Cited

U.S. PATENT DOCUMENTS

| | | | |
|---|---|---|---|
| 3,049,300 | 8/1962 | Lewis et al. . | |
| 3,369,749 | 2/1968 | Siegmund et al. | 236/15 E |
| 3,602,487 | 8/1971 | Johnson | 431/76 X |
| 3,722,811 | 3/1973 | Osburn | 431/12 X |
| 3,723,047 | 3/1973 | de Livois | 431/76 |
| 3,734,675 | 5/1973 | Osburn | 431/12 |
| 4,064,699 | 12/1977 | Martz | 60/664 |
| 4,097,218 | 6/1978 | Womack | 431/76 |
| 4,115,862 | 9/1978 | Stewart | 431/12 X |
| 4,138,725 | 2/1979 | Ikemoto et al. | 431/76 |
| 4,162,889 | 7/1979 | Shigemura | 431/76 |
| 4,173,124 | 11/1979 | Fujii et al. | 60/667 |
| 4,187,542 | 2/1980 | Ball et al. | 431/12 X |
| 4,296,727 | 10/1981 | Bryan | 431/76 X |
| 4,330,261 | 5/1982 | Sun | 431/76 X |
| 4,459,098 | 7/1984 | Turek et al. | 431/12 |

FOREIGN PATENT DOCUMENTS

| | | | |
|---|---|---|---|
| 0056522 | 4/1980 | Japan | 431/12 |
| 0121320 | 9/1980 | Japan | 431/12 |

*Primary Examiner*—Margaret A. Focarino

*Attorney, Agent, or Firm*—Watts,Hoffmann,Fisher & Heinke Co.

[57] ABSTRACT

A method and apparatus for controlling the combustion of multiple fuels, especially fuels having diverse combustion air requirements. A heating rate demand signal indicative of the heating rate desired is generated and is compared with a fuel based fuel heating rate signal. The larger of the two signals is selected to be an air demand signal that serves as set point for a combustion air controller. The flow rates of each of the fuels being burned is monitored and the resulting signals are scaled and summed to produce the heating rate signal. The fuel signals are also scaled by factors reflecting the combustion air requirements of the fuels. The signals are summed and combined with the fuel heating rate signal to produce a feedforward signal which in turn is combined with a signal reflecting the measured combustion air flow to produce an equivalent air heating rate signal. This latter signal is communicated to the combustion air controller and if different than the air demand signal causes an adjustment of the combustion air controller. The equivalent air signal is also compared with the heat demand signal and the lower of these two signals is communicated to a fuel heating demand subsystem which controls the metering of the fuels. An $0_2$ set point generator modifies the feedforward signal should a deviation occur between the $0_2$ set point and the measured $0_2$ content of flue gas exhausted by the combustion process.

19 Claims, 4 Drawing Figures

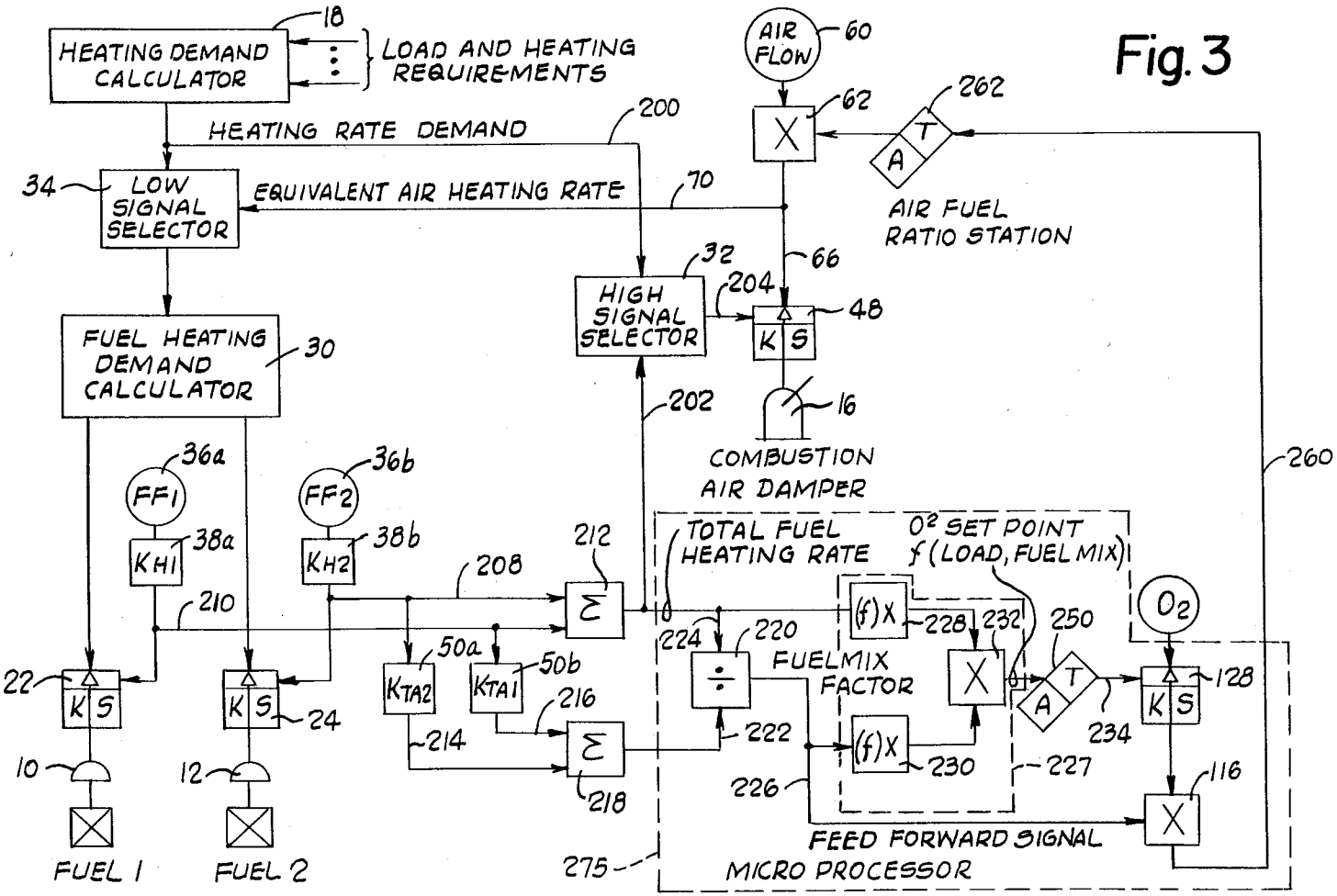
Fig. 3
HEATING DEMAND CALCULATOR
LOAD AND HEATING REQUIREMENTS
HEATING RATE DEMAND
EQUIVALENT AIR HEATING RATE
LOW SIGNAL SELECTOR
FUEL HEATING DEMAND CALCULATOR
HIGH SIGNAL SELECTOR
AIR FLOW
AIR FUEL RATIO STATION
COMBUSTION AIR DAMPER
TOTAL FUEL HEATING RATE
O2 SET POINT f (LOAD, FUEL MIX)
FUELMIX FACTOR
FEED FORWARD SIGNAL
MICRO PROCESSOR
FF1
FF2
KH1
KH2
KTA1
KTA2
FUEL 1
FUEL 2

AUTOMATIC COMBUSTION CONTROL APPARATUS AND METHOD

DESCRIPTION

1. Technical Field

The present invention relates generally to the control of a combustion process and in particular to a method and apparatus for controlling the combustion of multiple fuels having diverse combustion air requirements.

2. Background Art

An "off-gas" is a byproduct in many industrial processes such as steel making and oil refining. It is desirable, if possible, to utilize the energy available in what otherwise would be a waste gas.

In the steel making process, coke oven gas and blast furnace gas are typical by-products. Energy is often extracted from these gases by using them to fire steam boilers, stoves and furnaces elsewhere in the same plant.

It should be apparent that the availability and quantity of off-gas varies with the process operating level. Often steam boilers are responsible for burning all remaining off-gas after all other users have met their requirements. As a result, the quantity of off-gas available to the boilers varies quickly and over a wide range. In order to maintain a desired steam flow output from the steam generator, it is common to supply supplementary fuels such as coal, oil or natural gas to the boiler to compensate for the reduction or unavailability of the off-gas. At times, the boiler may be totally fired by a supplementary fuel whereas during times of peak off-gas production, a boiler may be almost totally fired by an off-gas.

In order to obtain efficient combustion, a predetermined fuel-to-air ratio, for each fuel being burned must be maintained. In general, the amount of air needed to completely burn the fuel in the combustion zone is greater than the "theoretical" required air as determined by stoichiometric combustion calculations. This "excess air" is usually expressed as a percentage of the required theoretical air. The amount of excess air required for a given fuel is determined not only by its properties but is also determined by burner characteristics. In general, the theoretical air required is obtained from combustion calculations or published references whereas the excess air requirement is obtained empirically from boiler tests.

In order to maximize energy extraction from the fuels being burned, the excess air must be closely controlled. If insufficient excess air is supplied, the combustion will be incomplete and unburned fuel will be exhausted. If too much excess air is supplied, some of the combustion heat will be lost to the exhaust stack.

Apparatus and methods have been proposed for controlling the fuel-to-air ratio so that a predetermined excess air is maintained. Some of the more recent proposals have included the analyzing of the flue gases and using the analysis to adjust the fuel-to-air ratio. For example, measuring the $O_2$ content of the flue gas has been suggested. The fuel-to-air ratio is then adjusted until a desired $O_2$ content is present in the products of combustion.

The problem with this type of control is that the combustion air requirements for the fuels being burned may differ. In addition, the $O_2$ content of the flue gas can vary substantially for different fuel mixes even though the excess air remains constant. For example, blast furnace gas which is a low-grade fuel having low caloric content, will generally have substantially less $O_2$ in the products of combustion as compared to natural gas for a given excess air input. The reason for this difference is that blast furnace gas has substantially more inert components than high-grade fuels such as gas or oil. The inerts do not react but instead dilute the products of combustion. Hence, if an $O_2$ level corresponding to ten percent excess air for natural gas is maintained in the combustion products when blast furnace gas is being burned, the actual excess air factor will be substantially greater than ten percent, resulting in inefficient burning and loss of heat energy.

Another problem associated with this type of control is the lag that occurs between a change in the fuel mixture being burned and the fuel-to-air ratio correction made by the feedback control based on the sensed change in the $O_2$ content in the combustion products. The fuel mix can change very rapidly since off-gas availability cannot be controlled by the boiler operator. In an extreme instance, a boiler being fired almost totally by blast furnace gas can frequently be switched over to natural gas instantly should blast furnace gas become unavailable. The air requirements for natural gas and blast furnace gas are substantially different. Approximately 25 percent more air is required per BTU of heating value for natural gas than is required for blast furnace gas. When the switch to natural gas occurs, the total fuel heat input will be maintained constant by the fuel control system, the air flow initially remains unchanged and the excess air level will instantly decrease. The measurement of the $O_2$ content in the flue gas by an oxygen analyzer and subsequent feedback control action normally takes a period of time that is substantially greater than the time it takes to switch from one fuel to another. As a result, during this transition period the fuel-to-air ratio will decrease and will remain low until the oxygen analyzer and controller stabilize.

The problem of maintaining proper fuel-to-air ratios becomes even more complex when multiple fuels are concurrently burned at flow rates that vary due to changes in the availability of the off-gas. As indicated above, when blast furnace gas is burned with optimum excess air, the resulting $O_2$ content of the flue gas will be substantially lower than the $O_2$ content of the flue gas when natural gas is burned with optimum excess air. If the target $O_2$ content in the flue gas is not changed when switching from blast furnace gas to natural gas, insufficient excess air will be supplied to burn the natural gas. Since an over rich mixture is undesirable, operators customarily burn blast furnace gas with greater than the optimum excess air in order to avoid a low excess air situation during the transition from blast furnace gas to natural gas or other high grade supplementary fuel. As noted above, the combustion of fuel with too much excess air is energy wasteful and reduces the efficiency of the boiler.

Apparatus for automatically changing the target $O_2$ setting for the combustion control have been proposed. However, this type of apparatus even when working properly, is still subject to the lag described above, that occurs between a change in the fuel mix and the feedback control action based on the measured change in the $O_2$ content of the flue gas by the analyzer. Thus, even though the $O_2$ target was changed, improper fuel-to-air ratios could still occur during the transition period or until the analyzer and oxygen controller reached equilibrium.

Additional methods, referred to as fuel-air cross-limiting, have been developed in the prior art to maintain fuel and air flows within predetermined limits of each other for parallel fully metered combustion controls. Limiting signals are calibrated for a specified air requirement per unit of fuel heat input and signal selectors are used to limit the individual demands for fuel flow and air flow.

These methods perform the required limiting functions for single fuel combustion or fuel mixes where the fuel-to-air ratio requirement remains at a known constant value. If the fuel-to-air ratio changes very slowly, recalibration of the limiting signals by feedback from flue gas analysis can be made to perform satisfactorily. However, in cases where the air requirement changes rapidly (e.g. varying mixes of off-gas and supplementary fuel) the feedback recalibration is too slow and the cross-limiting functions fail to prevent fuel rich mixtures at the critical fuel mix transition times. As a result, higher than optimum excess air targets are set by operators to prevent an overrich condition at the expense of combustion efficiency.

Further methods have been proposed for feedforward adjustment of air flow demand from fuel mix. These methods, however, have not been successfully integrated with the fuel-air cross-limiting methods and the flue gas analysis feedback methods. The deficiencies of the prior art feedforward adjustment methods include excessive excess air excursions on demand signal changes, slow load response, highly compromised control system calibrations, and the necessity to operate at higher excess air levels.

DISCLOSURE OF INVENTION

The present invention provides a new and improved apparatus and method for controlling the combustion of multiple fuels having diverse combustion air requirements in a single boiler, furnace etc. The disclosed method and apparatus includes a feedforward adjustment of fuel-to-air ratio in response to changes in the theoretical and excess air requirements of the changing fuel mixture and heating load. This feedforward adjustment also insures the correct functioning of the fuel-air cross-limiting functions for any fuel mixture and fuel demand changes. According to a feature of the invention, a simultaneous set point adjustment for the $O_2$ feedback control may be provided as part of the system for precise coordination with the feedforward adjustment.

Two "hard" cross-limiting functions are provided as part of the control system. Continuously calibrated feedforward and feedback cross-limiting signals operate jointly to prevent insufficient excess air combustion conditions. The first function limits the fuel demand to be no greater than the amount that can be properly burned by the available combustion air. The second function limits the combustion air demand to be no less than that required to properly burn the existing fuel mix and quantities.

According to the preferred apparatus and method, a "heating rate demand" signal (first signal) is generated by a heating rate demand development subsystem which reflects the desired heating level. In the case of a steam boiler, this signal may be related to boiler pressure, steam flow rate, etc. The combustion control monitors the fuel flow rates for all fuels being burned and generates a second signal referred to as the "fuel heating rate" signal indicative of the total heating value of the fuels being burned. The heating rate demand signal is then compared with the fuel heating rate signal and the higher of these two signals is communicated to a combustion air flow controller. The air controller is then adjusted in response to the communicated signal.

The actual air flow is monitored and a third signal called the "equivalent air heating rate" is generated which is a function of the measured air flow and the required fuel-to-air ratio for the fuels being burned. In essence, this third signal indicates the heating rate that the current air flow will support for the particular fuel mix being burned. This third signal is compared with the heating rate demand signal and the lower of the two signals is communicated to a fuel flow heating demand development control subsystem. This subsystem determines the proportion of the total fuel heating rate demand to be met by each of the individual fuel control loops. The specific form of this subsystem may vary and may be based on fuel priorities, splitting rules, preference fuels, fuel quantities available, or some combination of these criteria. The individual fuel heating demands (BTU'S/SEC.) are then communicated to the individual fuel control loops. Fuel control valves are then adjusted by the fuel controllers until the fuel demands are met.

According to one embodiment, the air-based and fuel-based signals are converted to common units of measurement so that they can be directly compared by the cross-limiting signal selector functions and air flow controller. In one embodiment, the measured fuel flow rates (LBS./SEC.) are each multiplied by a heating value factor having dimensions "BTU/LBS. FUEL". The results for each of the fuels are then summed in order to obtain a gross fuel heating rate signal expressed in BTU/SEC. available from the fuels being burned at the measured flow rates. The flow rate signals of each of the fuels are also scaled by a theoretical air requirement factor having dimensions "LBS. THEORETICAL AIR/BTU" and an excess air factor having dimensions "LBS. TOTAL AIR/LBS. THEORETICAL AIR". The individual results are summed to arrive at the total required combustion air for the fuels being burned expressed in "LBS. TOTAL AIR/SEC."

The heating rate demand signal generated by the heating rate demand development subsystem has units of "BTU/SEC". The heating rate demand signal is compared with the gross fuel heating rate signal (also having units of BTU/SEC.) and the larger of the two signals is selected to be the "air demand signal" which is communicated to a combustion air controller.

The fuel heating rate signal (expressed in BTU/SEC.) is divided by the required combustion air signal (expressed in LBS. TOTAL AIR/SEC.) to produce a signal having units "BTU/LBS. TOTAL AIR". For purposes of explanation, this result is termed the "total air requirement factor" since it is related to the combustion air requirement per unit BTU of the fuel mixture being burned.

As indicated above, the flow rate of combustion air is also monitored. The measured air flow rate (having units LBS. TOTAL AIR/SEC.) is multiplied by the total air requirements factor to generate an "equivalent air heating rate" signal having units BTU/SEC. In essence, the signal is indicative of the heating rate the combustion air is able to support for the measured flow rates and fuel mixture. This equivalent air heating rate signal is also sent to the combustion air controller and should the signal not correspond to the air demand signal, the air flow is adjusted accordingly.

The equivalent air heating rate signal is also directly comparable with the heating rate demand signal since both have units BTU/SEC. The lower of the two signals is then used to generate control signals for the fuel controllers. The comparisons provide "hard" cross limits in that the fuel flow rates will only be increased if sufficient air flow is available for the particular fuel mixture being burned and hence the disclosed control inhibits an overrich combustion condition. Similarly the air flow demand in inhibited from being decreased below the quantity of air necessary for proper combustion of the existing fuel mix and quantities.

It should be noted that the identified factors or scalers used to convert the various air based and fuel based signals, which could not otherwise be compared, to signals having common units can be obtained from measurements, calculations, or published specifications of the fuels. If obtained by experimentation the factors would be average values. Alternately, if real time fuel analysis or heating value measurements are available, the heating value and theoretical air requirement factors can be continuously readjusted to compensate for measured changes in fuel characteristics. Further, the excess air requirement factors may be continuously readjusted as a nonlinear function of load and/or fuel mixture based on a model developed from test results or literature data.

According to another embodiment, an $O_2$ set point generator is provided as part of the control. According to the invention, the $O_2$ set point may be calculated from the theoretical air requirment and total air requirement factors and therefore may be a function of fuel mixture or load or both. As the fuel mix and/or load change, the target $O_2$ level is also changed. In accordance with this embodiment, the $O_2$ controller compares the measured $O_2$ (in the flue gas) with the target $O_2$ level and modifies the total air requirement feedforward signal that is used to multiply the air flow measurement signal. In the first embodiment, the total air requirement factor was directly multiplied by the measured air flow rate to arrive at a BTU/SEC. signal which was directly comparable to the heating rate demand signal. The signal in the second embodiment is also directly comparable with the heating rate demand signal; however, it reflects not only the fuel mix and load, but is also modified should the $O_2$ content of the flue gas not be at the desired level as determined by the $O_2$ set point generator.

It must be emphasized that the $O_2$ controller only modifies the fuel mix factor and does not determined the factor by itself. As a result, the control relies on the $O_2$ measurement of the flue gas as a means for "fine tuning" the combustion process. The feedforward adjustment of the fuel-to-air ratio provided by the control utilizing measured fuel flow rates coupled with the adjustment of the fuel flow rate signals by factors related to the heating value of each of the fuels being burned, the theoretical air required for each of the fuels and the excess air required for the individual fuels results in fuel air ratios that closely approximate the ideal ratios irrespective of the $O_2$ analysis. In short, the control system does not rely on the $O_2$ analysis to set the desired air flow. Instead, the air flow is determined by the heating rate demand, the measured fuel flow for each of the available fuels and the measured air flow; the fuel-to-air ratio adjusted by a feedforward loop as demand and/or fuel availability changes. The $O_2$ analysis and attendant control function merely serve to compensate for slight errors in the factors used to compute the feedforward signals. Since the factors, if not generated by a real time analysis of the individual fuels, are actually average values obtained by experimentation or prior measurement, slight errors in the ratio can occur. The $O_2$ controller eliminates or reduces this error. As a result the fuel-to-air ratio is maintained close to its proper value at all times, particularly during rapid changes in fuel mix, by the feedforward control while the slower acting feedback modification derived from flue gas $O_2$ measurements improves the long term accuracy for slower changing fuel characteristics and flow meter errors.

According to a third embodiment of the invention, the target $O_2$ signal generated by the signal generator which is a function of both measured fuel mix and load, and the method by which this signal modifies the feedforward signal is implemented in a simplified way. In this embodiment the feedforward signal represents a fuel mix factor based on theoretical air requirements for the fuel. A fuel-to-air ratio adjustment for the excess air requirement is provided by a feedback signal from the $O_2$ controller. The $O_2$ set point is determined by an $O_2$ set point generator as a function of load and fuel mixture using a model that approximates the experimentally determined functional dependence of the $O_2$ content on load and fuel mixture.

In the preferred and illustrated construction of the third embodiment, the $O_2$ set point is produced by combining two individual signals, one being related to the load as determined by measured steam flow or calculated fuel heating rate and the other being a fuel mix factor. In the disclosed arrangement, the two signals are multiplied to arrive at the target $O_2$ set point. This signal is then fed to the $O_2$ controller which in turn modifies, if needed, the fuel mix feedforward signal that is communicated to the fuel-to-air ratio multiplier. The resulting signal is then sent to the air flow controller for comparison with the air flow demand.

To achieve an effective fuel-to-air ratio control the feedforward and feedback corrections must be coordinated. This is achieved by calculating both the $O_2$ set point and feedforward correction based on the same factors, i.e. the heating value, the theoretical air requirement, and the excess air requirement factors.

With the present invention, multiple fuels having diverse air requirements can be burned efficiently. The use of feedforward signals and hard cross limits insures that sufficient air is available for the measured fuel flow rates at any given fuel mixture. Unlike the prior art, signals representing the measured flow rate for each of the fuels being burned are treated separately and are converted to a fuel heating rate signal that is related not only to the flow rate but also the fuel composition and the theoretical and excess air required for that fuel. The resulting heating rate signals are combined to arrive at a total air requirement factor which is then used to control the flow of combustion air. As a result, the combustion air will be adjusted and changed in response to not only changes in the fuel flow rates but also changes in the proportions of fuels being burned for a given heating rate demand. Thus, when changing the proportion of a low caloric fuel (such as blast furnace gas) while maintaining a constant heating rate output, the combustion air flow rate will be quickly adjusted to compensate for the change in combustion air requirements. The control system changes the fuel-to-air ratio by means of a feedforward loop and does not rely on an $O_2$ analysis to make the initial adjustment. Simultaneously, the fuel-air cross-limiting functions are maintained valid at all times to prevent fuel rich combustion conditions during transient operations. The $O_2$ feedback control is only used to fine tune the fuel-to-air ratio. An oxygen set point is generated for the $O_2$ feedback control in precise coordination with the generated feedforward fuel-to-air ratio adjustment signal. With the disclosed apparatus and method, relatively precise combustion control can be achieved when burning multiple fuels having diverse air requirements.

Additional features of the invention will become apparent and a fuller understanding obtained by reading the following detailed description made in connection with the accompanying drawings.

BEST MODE FOR CARRYING OUT THE INVENTION

Figure 1:
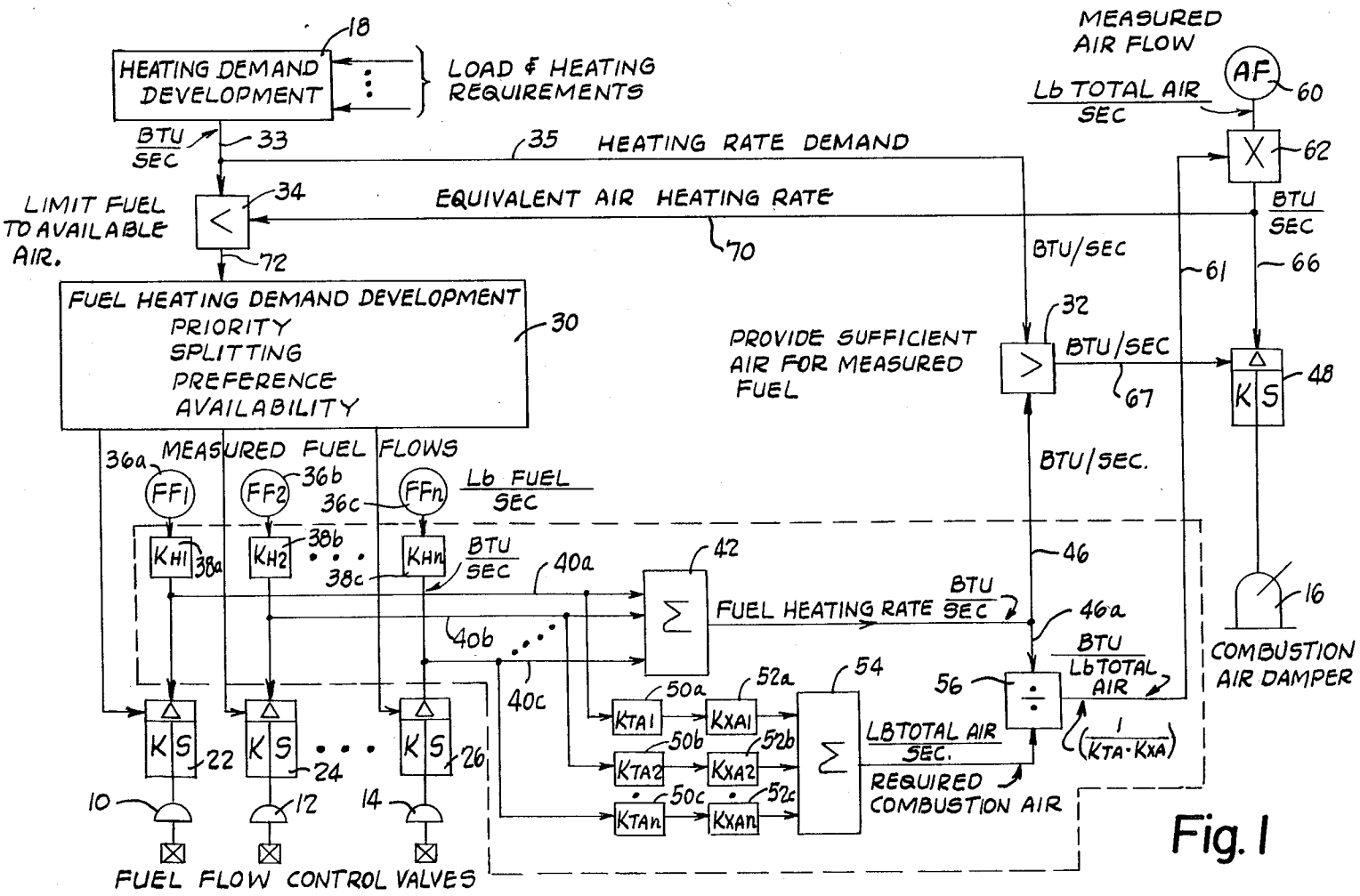
FIG. 1 is a schematic representation of an air-to-fuel ratio controller constructed in accordance with one embodiment of the present invention.

FIG. 1 illustrates schematically, a fuel-to-air ratio control system constructed in accordance with a preferred embodiment of the invention. In the illustrated embodiment, the control system is operative to manipulate fuel control valves 10, 12, 14 and a combustion air damper 16 to adjust the proportions of various fuels being burned and the overall combustion air flow.

The disclosed control system can be used to control the concurrent combustion of multiple fuels having similar or diverse combustion air requirements. Although the control of three fuels is shown, the disclosed system can accommodate virtually an unlimited number of fuels (as indicated by the dots between various components).

The required heating is determined by a heating rate demand development subsystem 18 which generates a required heating rate demand signal, preferably expressed in BTU's per second. For example, if the system is used to control the burners for a steam boiler, the generated "HEATING RATE DEMAND" signal (in BTU'S/SEC.) would reflect the amount of steam desired. Alternately, the heating signal could be a function of desired steam pressure, or the desired electrical output of a generator driven by the steam boiler. The demand subsystem 18 may itself be a controller or other conventional device and is not considered part of the present invention. Various devices such as process computers and discrete controllers are currently available that would perform satisfactorily as the heating rate demand development subsystem.

The fuel control valves 10, 12, 14 are controlled by associated controllers 22, 24, 26. The controllers are conventional and are preferably of the proportional plus integrating type.

The fuel demand signals for the controllers 22, 24, 26 are generated by a fuel heating demand subsystem indicated schematically by the reference character 30. This subsystem may comprise a variety of conventional devices such as a programmed controller, computer, etc. In response to a heating rate demand signal, the fuel heating demand subsystem 30 determines the proportions of the various fuels to be mixed, if multiple fuels are burned. The fuel selection and/or proportion will be dependent on the availability of the fuels, a predetermined priority or preference, or other criteria. For example, in some applications, it may be desirable to burn all available first off-gas and if the heat demand cannot be met by the available first off-gas to burn a second off-gas; only if the fuel heat demand cannot be met by available off-gases will the subsystem open the valve or valves controlling supplementary fuels. The actual fuel heating demand development subsystem 30 and associated control sequence will depend on the application.

The output signal from the heating rate demand subsystem 18 which is indicative of the heating required and which preferably bears units of measurements of BTU's per second is fed to both a high select comparator 32 and a low select comparator 34 via respective signal lines 35, 33.

The actual fuel flow rates to burners (not shown) are monitored by flow sensors 36*a*, 36*b*, 36*c*. Normally, the signals will represent the fuel flow in pounds fuel per second. These flow rate signals are converted to signals having units of BTU's per second by respective scalers 38*a*, 38*b*, 38*c*. Each scaler includes a factor $K_H$ corresponding to the heating value (expressed in BTU's per pound) for the associated fuel. The value of the factor can be obtained from published references or by experimentation. The resulting heating rate signals, sent along signal lines 40*a*, 40*b*, 40*c*, are summed in a summer 42 to yield the total fuel heating rate expressed in BTU's per second. This total BTU per second signal is then conveyed to the high select comparator 32 via signal line 46. The heating rate demand signal (sent along signal line 35) is compared with the measured fuel signal (also expressed in BTU's per second) and the larger of the two signals is communicated to a combustion air flow controller 48.

Returning to the fuel based signals present in the signal lines 40*a*, 40*b* and 40*c*, signals representing the combustion air required for the measured fuel flows are generated. As seen in FIG. 1, each heating rate signal is scaled by a factor $K_{TA}$ representing the "lbs. theoretical air required per BTU" of fuel and a factor $K_{XA}$ representing the excess air requirement (normally expressed as the ratio "lbs. total air/lbs. theoretical air") so that the resulting signal represents the "lbs. total air per second" that is required for a given fuel at the measured flow rate. In particular, the signal in signal line 40*a* is scaled by a theoretical air factor $K_{TA1}$ represented by block 50*a* and an excess air factor $K_{XA1}$ represented by block 52*a*. Similarly the signal in signal lines 40*b*, 40*c* are scaled by factors 50*b*, 52*b* and 50*c*, 52*c*, respectively. The resulting signals are then summed in a summer 54 to produce a signal representing the "lbs. of total air per second" that is required to burn the fuels at their measured fuel flow rates. If more than three fuels are to be burned, additional fuel loops and scalers can be added as indicated by the dots in FIG. 1.

The fuel heating rate signal in signal line 46 is also communicated to a divider 56 along signal line 46*a* and is divided by the "required combustion air signal"(the output of the summer 54) to yield a feedforward signal having units of BTU's per lb. total air. For purposes of explanation, this signal shall be termed the total air requirement factor for it represents both the theoretical and excess air requirements of the fuel mixture and is dependent on the relative fuel proportions and load. Specifically, when the overall heating rate remains constant, this signal will vary dramatically depending on the ratio between the low grade and high grade fuels being burned since these fuels usually have diverse theoretical and excess air requirements. It should be noted here that the excess air requirement for a given fuel may vary with load (or the heating rate). In some applications as depicted by FIG. 1, the scaler $K_{XA}$ may be treated as a constant and the resulting signal would thus be independent of load. However, the present invention also contemplates the readjustment of the scalers $K_{XA}$ as nonlinear functions of load and/or fuel mixture based on a mathematical model developed from test results, previous experience or published data. Should the dependence of the excess requirement on load and fuel proportions be known from test results or other sources, those skilled in the art could develop a mathematical model by which the scalers $K_{XA}$ could be varied as a function of load and/or factors characterizing the fuel proportions in the mixture. The mathematical model could be expressed as polynomial functions which would be implemented by suitable apparatus such as program controllers or computers.

The actual combustion air flow to the burner is monitored by an air flow sensor 60 which generates an air flow rate signal having units "lbs. total air per second". The total air requirement factor signal (in signal line 61) is combined with the measured air flow signal by an fuel-to-air ratio multiplier 62 to generate a signal having units of measurement "BTU per second" which represents the heating rate the measured combustion air can support based on the measured fuel flows and fuel mix. As seen in the FIG. 1, this "equivalent air heating rate" signal which is output on signal line 66 is communicated to the low select comparator 34 via signal line 70. The comparator 34 compares the heating rate demand signal as generated by the heating rate demand subsystem 18 with the equivalent air heating rate signal and the lower of the two signals is then communicated to the fuel heating demand subsystem 30. With the present configuration, the fuel flow is limited to the measured and, hence available, air flow. The output of the comparator 34 (signal line 72) will only call for a fuel flow rate that can be properly burned with the measured air flow.

The air-based "equivalent air heating rate" signal in the signal line 66 is also communicated to the combustion air flow controller 48. Should this signal be different from the fuel-based "air demand" signal which is output from the high select comparator 32 via signal line 67, the controller 48 will readjust the combustion air damper. In effect the "air demand" signal output by the comparator 32 is a set point for the air flow controller 48. The "equivalent air heating rate" signal in line 66 as derived from the measured air flow and feedforward signal (in line 61) is compared with the air demand signal and if different causes the controller to adjust the damper 16 accordingly.

The total air requirement signal (in signal line 61), as described above, provides an immediate feedforward adjustment of the fuel-to-air ratio when combustion air requirements vary due to the changes in fuel mixture and/or load. The resulting change in the "equivalent air heating rate" signal in the line 66 will prompt the air flow controller 48 to immediately adjust the combustion air flow to meet the new air requirements. This feedforward adjustment of the fuel-to-air ratio for the changes in combustion air requirements is an important feature of the invention.

Another important feature of this invention is that the feedforward adjustment of the fuel-to-air ratio insures validity of fuel-air cross-limiting functions. The "equivalent air heating rate" signal communicated to the comparator 34 through the line 70 is immediately calibrated by the feedforward adjustment for the new air requirements. This "calibration" enables a valid comparison between this signal and the "heating rate demand" signal which are communicated to the comparator 34 through the lines 70, 33 during any fuel mixture and load changes. Since the feed forward adjustment is performed on the air flow signal both signals entering the comparator 34 are heating rate based and, therefore, are balanced in steady-state conditions. Validity of the cross-limiting functions is provided for all operating conditions.

In a steady-state condition the signals entering the comparators 32, 34 are balanced by the action of the fuel flow controllers 22, 24, 26 and the air flow controller 48 while the fuel-to-air ratio is established by the multiplier 62 to maintain the desirable excess air level for the current fuel mixture and load. When the fuel mixture changes so that more air is required to support the existing heating rate (which is unchanged) the total air requirement factor will decrease. The equivalent air heating rate signal will be readjusted by the feedforward correction in the multiplier 62 to a lower value. This lower signal will be communicated to the air flow controller 48. Since the "air demand signal" for this controller communicated from the high select comparator 32 via signal line 67 remains unchanged, the controller will open the combustion air damper to increase the air flow to meet the new air requirements. When the new steady-state condition is reached, the "equivalent air heating rate" signal will be balanced again with both the air demand signal (signal line 67) and the heating rate demand signal (signal line 33), and, therefore, the signals in the low select comparator 34 will be balanced. Similar control actions will be performed when the fuel mixture changes in the opposite direction (to lower air requirement).

In both cases the cross-limiting functions will be valid and maintained. When additional heating is required, the high select comparator 32 will communicate the resulting higher signal to the combustion air controller 48 which will attempt to open the combustion air damper further. If the combustion air does in fact increase (as sensed by the air flow sensor 60) the resulting increased output will be communicated via signal line 70 to the low select comparator which in turn will communicate the higher heating rate signal to the fuel heating demand subsystem 30. It should be apparent that the fuel flow rates will only increase on a heating demand increase if the sensed combustion air is sufficient to sustain the increased fuel flow rates.

With the present invention, a condition of insufficient combustion air for the fuel being burned is inhibited. Unlike the prior art, fuels with different air requirements are treated separately and signals representing the air required for each fuel being burned are individually generated and then combined to produce a signal indicative of the total air required to burn the fuels at the measured flow rates and mixture ratios. Thus, multiple fuels having diverse air requirements can be burned at varying proportions and flow rates while maintaining desired air-to-fuel ratios. The continuous feedforward calibration of the fuel-to-air ratio maintains the validity of the fuel-air cross-limit functioning at all time.

Figure 2:
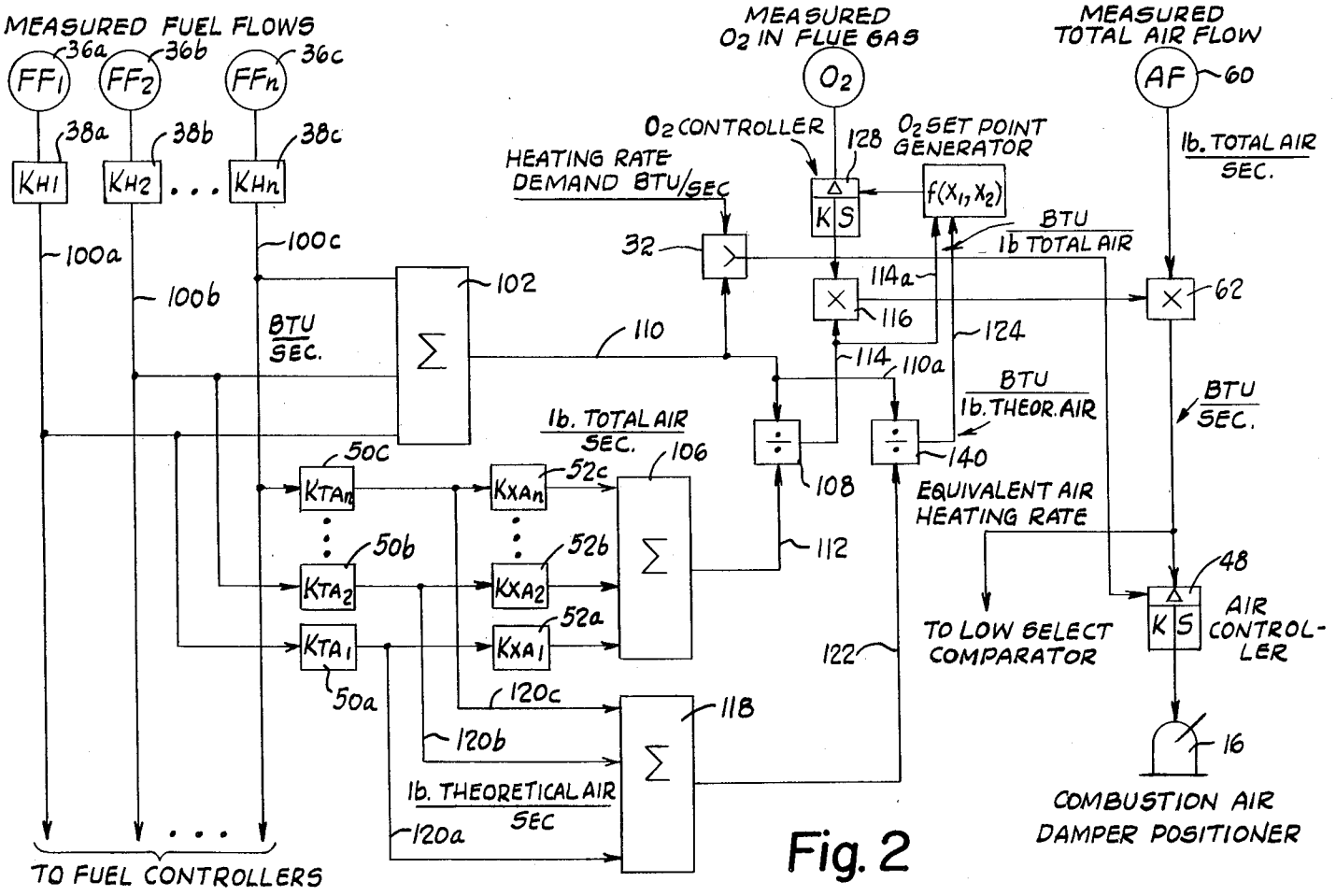
FIG. 2 is a schematic representation of an air-to-fuel controller constructed in accordance with another embodiment of the invention; and, FIG. 3 is a schematic representation of still another embodiment of an air-to-fuel controller constructed in accordance with the present invention.

Turning now to FIG. 2, an air-to-fuel ratio control system is illustrated that includes apparatus for generating an $O_2$ set point for an $O_2$ controller used in conjunction with the analysis of the $O_2$ content in the combustion by-products. In the broad terms of the invention, the $O_2$ controller modifies the feed forward signal which ultimately causes the readjustment of the combustion air flow to compensate for slower changes in fuel characteristics, and flow metering errors.

To simplify the description of the system shown in FIG. 2, components having functions substantially identical or similiar to those in FIG. 1 are designated by like reference characters. Certain components are omitted such as the heating rate demand development subsystem (indicated by the reference character 18 in FIG. 1) and the fuel heating rate demand subsystem (indicated by the reference character 30 in FIG. 1) as well as the fuel controllers 22, 24, 26 the fuel control valves 10, 12, 14 and the low select comparator 34.

As in FIG. 1, fuel flow rates are monitored by fuel sensors 36*a*, 36*b*, 36*c*. The signals are output on lines 100*a*, 100*b*, 100*c* and are scaled by the scalers 38*a*, 38*b*, 38*c*, which convert the signals to units of BTU's per second. The resulting signals are summed in a summer 102 to arrive at a total measured fuel heating rate in BTU's per second for the measured fuels. The signals in the signal lines 100*a*, 100*b*, 100*c* are also scaled by the scalers 50*a*, 50*b*, 50*c*, representing the theoretical air required for the measured flow rate. The signals representing the individual theoretical air requirements for each of the fuels are also scaled by the excess air factors 52*a*, 52*b*, 52*c*. The three signals are summed in a summer 106 to arrive at a signal representing the "lbs. total air per second" required to react the measured fuel flows.

The output of the summer 102 (the total fuel heating rate signal) and the output of the summer 106 (the total air requirement for the measured fuels) are communicated to a divider 108 via signal lines 110, 112. The output of the divider 108 is a feedforward signal representing the "BTU's per lb. total air", and is a total air requirement factor that is communicated via signal line 114 to a multiplier 116.

The multiplier 116 precedes the air-to-fuel ratio multiplier 62 which, as described in connection with FIG. 1, is used to generate the "equivalent air heating rate" signal for the air flow controller 48. In essence, the multiplier 116 modifies the feed forward signal in response to sensed differences between the measured $O_2$ in the flue gas and a target set point as will be described below.

As seen in FIG. 2, the signals in the the signal lines 100*a*, 100*b*, 100*c* are communicated to a summer 118 via signal lines 120*a*, 120*b*, 120*c* after being scaled by the scalers 50*a*, 50*b*, 50*c*. The output of the summer 118 represents the total theoretical air per second required for the measured fuel flows.

The output signal which has units of "lbs. theoretical air per second" is communicated to a divider 140 via signal line 122 as is the "fuel heating rate signal" in branch signal line 110*a*. The resulting signal, having units of "BTU'S per lb. theoretical air", is a theoretical air requirement factor, which is also termed a "fuel mix factor" for its value may characterize the fuel proportions in the mixture.

It is known in the art that a theoretical air requirement per BTU of fuel heating value is a virtually constant value for each type of fuel and is similar for most high grade fuels. Some off-gases, like the blast furnace gas, containing considerable amounts of carbon monoxide, have substantially different theoretical air requirements. The fuel mix factor relates the heating value of a fuel mixture to the theoretical air requirements of the fuel mixture. The fuel mix factor is a function of the fuel proportions in the mixture, and most importantly reflects the proportion of off-gas in the mixture.

The fuel mix factor, which is output by the divider 140 to the signal line 124, is communicated to an $O_2$ set point function generator 126. Another input to the function generator 126 is the total air requirement factor via the branch line 114*a*. The total air requirement factor and theoretical air requirement factor (fuel mix factor) are combined in the function generator 126 to produce an excess air factor for the fuel mixture as follows:

$$K_{XA} = \frac{\text{Theoretical Air Requirement Factor}}{\text{Total Air Requirement Factor}}$$

This factor, as it is clear from the previous description, is a function of fuel mixture and load.

The $O_2$ set point may be determined from $K_{XA}$ and the fuel mix factor, which characterizes the fuel proportion in the mixture, using combustion calculation equations known in the art.

The generator 126 may take many forms and may be conventionally implemented using pneumatic and/or electronic components.

The output of the set point generator 126 is communicated to an $O_2$ controller 128. Should the measured $O_2$ deviate from the set point, the $O_2$ controller would operate to modify the feedforward signal (by means of the multiplier 116) so that the signal communicated to the air-to-fuel ratio multiplier 62 is adjusted for the sensed deviation. When the air requirement for the fuel mixture changes, the feedforward signal readjusts the fuel-to-air ratio as described above. Simultaneously, the $O_2$ set point is changed for the new air requirements which produces a corresponding feedback signal readjustment by the controller 128. The feedforward and feedback readjustments must be coordinated to provide an effective fuel-to-air ratio control. This coordination, which is an important feature of the invention, is provided by calculating the $O_2$ set point based on the same factors which are used to calculate the feedforward fuel-to-air ratio adjustment as described above.

The remainder of the control system is essentially the same as the control system shown in FIG. 1. The "equivalent air heating rate" signal which is output from the multiplier 62 is communicated to the air flow controller 48 which results in an adjustment of the combustion air flow. The output from the multiplier 62 is also communicated to the low select comparator (element 34 in FIG. 1) so that the lower of the signals is communicated to the fuel heating demand subsystem (element 30 in FIG. 1).

FIG. 3 illustrates another embodiment of the control system which includes a simplified arrangement for a generating feedforward fuel-to-air ratio adjustment and a target $O_2$ set point based on both measured fuel mix and load. Again, in order to simplify the explanation, components providing identical or similar functions to components shown in FIGS. 1 and 2 are designated by like reference characters. In addition, the control system is illustrated as controlling the combustion of two fuels to further simplify the discussion. For purposes of explanation fuel 1 is assumed to be off-gas such as blast furnace gas and fuel 2 is assumed to be a high grade supplementary fuel such as natural gas.

As described previously, the control system includes a heating rate demand subsystem 18 for generating a signal indicative of the required heating rate. This signal is communicated via signal line 200 to the high select comparator 32.

The heating rate demand signal is compared with the total heating rate signal as calculated from measured fuel flow data communicated via signal line 202 and the higher of the two signals is communicated via signal line 204 to the combustion air flow controller 48 and acts as a set point for the controller. As described previously, the fuel flow rates are measured by sensors 36*a*, 36*b*, are scaled by the scalers 38*a*, 38*b* and are output to signal lines 208, 210. The signals are summed by a summer 212 to produce a total fuel heating rate signal.

The individual fuel rate signals are also scaled by the associated theoretical air related scalers 50*a*, 50*b*, and the resulting signals on signal lines 214, 216 are summed by a summer 218. The summer 218 produces a signal representing the theoretical air required per second to burn the measured fuels. This air requirement signal and the output of the summer 212 are communicated to a divider 220 via signal lines 222, 224, respectively. The output of the divider 220 is the signal representing a fuel mix factor which has units of BTU per 1*b*. theoretical air. The fuel mix factor is communicated as a feedforward signal to the $O_2$ multiplier 116 via signal line 226.

In this embodiment a feedforward adjustment of the fuel-to-air ratio is based on the theoretical air requirement of the fuel mixture represented by the fuel mix factor. A fuel-to-air ratio adjustment for the excess air requirement is provided in this embodiment by a feedback signal from the $O_2$ controller 128. The appropriate $O_2$ set point is generated by the functional block 227 as a function of load and fuel mixture.

According to the invention, the signal representing the total fuel heating rate is communicated to a function generator 228 to produce a signal that is a function of load. The output of the divider 220 which is the fuel mix factor is communicated to another function generator 230 which produces a signal that is a function of fuel mix. The load and fuel mix related signals are combined by a multiplier 232 to produce an $O_2$ set point signal in signal line 234 which is communicated to the $O_2$ controller 128. High and low signal limits are imposed on the output of the multiplier 232 to establish a desirable range for the oxygen set point signal.

Figure 4:
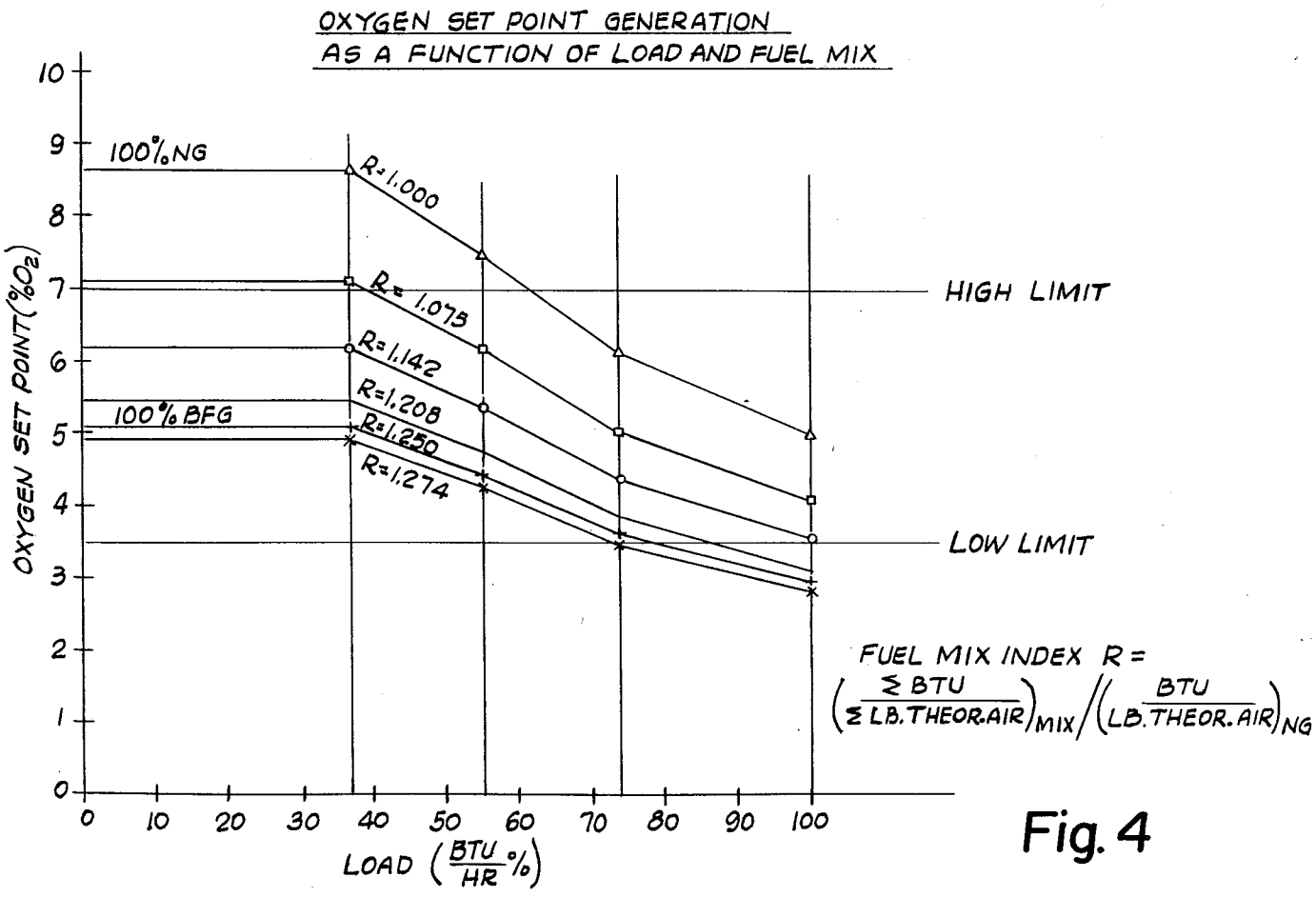
FIG. 4 is a graph of the functional relationship between $O_2$ concentration and the total fuel heat rate.

An auto/manual station 250 may be interposed in the signal line to provide a manual adjustment for the $O_2$ set point should the automatic calculation by the function generators not be desired. The functional block 227 provides approximation of the experimentally determined dependence of the target $O_2$ concentration on the load (total fuel heat rate) and fuel mixture represented by the fuel mix factor. An example of such a dependence is shown in FIG. 4. In this figure the $O_2$ concentration is presented as a function of load expressed as a percent of the maximum fuel heat input and a fuel mix index which is a ratio of the fuel mix factor for mixture of blast furnace gas (BFG) and natural gas (NG) and the theoretical air requirement factor (BTU/lbs.) of natural gas. The functional relationship of two variables similar to the one in FIG. 4 may be approximated by a product of two functions of one variable. These functions in this embodiment are incorporated in function generators 228, 230. Similar approximation may be developed by those skilled in the art for other experimental dependencies of target $O_2$ concentrations on load and fuel mix factors.

As described previously, the output of the $O_2$ controller 128 is used to modify the feedforward signal in signal line 226 should the measured $O_2$ content in the flue gas be different from the target value as generated by the function block 227 or, alternately, the manual adjustment 250. The modified fuel mix factor (which is output by the multiplier 116) is communicated to the air-to-fuel ratio multiplier 62 via signal line 260. In the illustrated embodiment, the signal line 260 also includes an auto/-manual station 262 for switching off the feedforward signal line and interposing a manual adjustment.

The control system illustrated schematically in FIG. 3 can be constructed from various types of hardware. An implementation of the illustrated system was constructed by the inventors using both pneumatic and electronic components. The fuel and air flow controllers as well as the high and low select comparators 32, 34 were pneumatic devices and in particular the functions were provided by combinations of a device known as the "Hagan Ratio Totalizer" available from the Westinghouse Electric Corporation. For the feedforward multiplier, a pneumatic analog computer known as a Model B3 analog computer available from Sorteberg Controls Corp. was used. "Hagan Ratio Totalizer" units were also used for the various scalar units as well as the summers. A microprocessor base controller was used to provide the functions outlined by the dot-dash line 275 in FIG. 3. In particular, the controller used was a General Purpose Controller Model 1500 available from Westinghouse Electric Corporation. The divider 220, the function generators 228, 230, multiplier 116, $O_2$ controller 128, and multiplier 62 were all implemented by software, the generation of which should be readily achieved by those skilled in the art. It should also be apparent that the function generators can be easily reprogrammed to generate $O_2$ set points that are a function of fuel mix alone or combinations of other process factors including but not limited to load.

It should also be apparent that the implementation described above that includes both pneumatic and electronic devices merely represents one example of how to construct the control system schematically illustrated by FIG. 3. Control systems implemented entirely with electronic hardware or alternately with pneumatic hardware are all possible and are contemplated by the present invention.

All controllers and computing functions can be implemented with electronic analog modules such as Foxboro SPEC 200 controllers or electronic digital models such as Bailey Network 90 Multifunction controllers or by software subroutines in a general purpose process control computer.

It should be apparent that the present invention provides a greatly improved combustion control system for concurrently burning multiple fuels, especially fuels having diverse combustion air requirements. As indicated, an important feature of the invention is the cross-limiting function which is valid under all operating conditions. Validity of the limiting function is assured even during transient periods because the function does not rely on feedback from an $O_2$ analysis of the flue gas. The cross-limiting function operates accurately irrespective of the proportions of fuels being burned or their combustion air requirements. By eliminating the reliance on the $O_2$ measurement, the air based and fuel based signals are directly comparable at all times since the lag between a process change and the sensed change in the flue gas analysis is eliminated.

Unlike the prior art, a feedback loop involving the measurement of the $O_2$ content in the flue gas and the comparison with a target $O_2$ set point is used to fine tune the combustion process. The $O_2$ analysis and resulting control functions merely compensate for errors in fuel metering, errors in the scaling factors, etc.

As described, the various scaling factors $K_H$, $K_{TA}$, and $K_{XA}$ may be obtained from published references, combustion calculations or direct measurement. In applications, where real time fuel analysis is not available, an average value is selected. However, the present invention contemplates a control system in which one or more of the scalers are adjusted in response to a real time analysis of the fuels. In addition, the invention also contemplates the adjustment of the excess air scalers $K_{XA}$ as a function of load and/or fuel mix. The dependency of the excess air scaler $K_{XA}$ on either load or fuel mix can also be obtained based on experimentally determined dependency of the desirable excess air on load and fuel mixture.

The function generator for generating a target $O_2$ set point can be implemented by various devices including discrete control devices or programmable controllers and computers. The functional relationship between the target $O_2$ set point and fuel mix and load can be obtained from published data, combustion calculations, experimental data or combinations thereof. In the embodiment illustrated in FIG. 3, the target $O_2$ set point is approximated by combining two individual functions, one being related to load and the other being related to fuel mix. It should also be noted that functions and their combination are implemented by software in the microprocessor 275.

FIG. 4 represents the relationship between the oxygen set point as a function of load and fuel mix. The data represented by the graph, was obtained experimentally and by combustion calculations using published data. Once the dependency of the oxygen set point to load and fuel mix is established, functions approximating the relationship are implemented in the control system. As indicated above, in the control system illustrated in FIG. 3, a function of two variables relating to the $O_2$ set point to both load and fuel mix is approximated by combining two single variable functions, one related to load and the other related to fuel mix.

In the preferred arrangement, the $O_2$ set point is a function of both fuel mix and load. However, it should be understood that satisfactory combustion control can be achieved in certain cases by generating an $O_2$ set point which is a function of fuel mix alone. A single variable function generator is contemplated by the present invention.

In explaining the invention, the signals have been described as having various units of measurement such as BTU/SEC., LBS. TOTAL AIR/SEC., BTU'S PER LB. TOTAL AIR, etc. It should be recognized that the invention is not limited to these units of measurements. Those skilled in the art will appreciate that equivalent units can be used.

Moreover, in actually implementing the present invention, the signals themselves are dimensionless. As known in the art, control signals manipulated by controllers, computers, etc., actually represent a percentage of a calibration value. However, in calibrating the apparatus, the units described above or their equivalent would be used.

Although the invention has been described with a certain degree of particularity, it should be apparent that those skilled in the art can make various changes to it without departing from the spirit or scope of the invention as hereinafter claimed.

We claim:

1. For a combustion process using multiple fuels having diverse combustion air requirements, a method for controlling the fuel-to-air ratio, comprising the steps of:

(a) generating a heating rate demand signal indicative of the amount of heating required;

(b) measuring the current fuel flow rate for each fuel being burned and generating a fuel heating rate signal indicative of the heating capacity of said fuels;

(c) generating individual fuel demand signals in a fuel heating rate demand development subsystem;

(d) adjusting the flow of individual fuels in response to their individual demand signal;

(e) generating an air requirement signal for measured fuel flows and their air requirements;

(f) generating a feedforward signal related to said air requirement signal;

(g) comparing said heating rate demand signal with said fuel heating rate signal and communicating the higher of said signals to a combustion air flow controller;

(h) adjusting said air controller in response to said communicated signal;

(i) measuring the actual air flow;

(j) generating an equivalent air heating rate signal which is a function of the measured air flow and said feedforward signal; and, (k) comparing said equivalent air heating rate signal with said heating rate demand signal and communicating the lower of said signals to said fuel heating rate demand development subsystem.

2. The method of claim 1 wherein said air requirement signal is a function of the measured fuel flows, theoretical air requirements and excess air requirements.

3. The method of claim 2 wherein said excess air requirements are calculated as a function of fuel mixture.

4. The method of claim 3 wherein said excess air requirements are calculated as a function of load an fuel mixture.

5. The method of claim 1 further including the steps of:

(a) generating a target $O_2$ set point as a function of fuel mixture and the theoretical air requirement;

(b) monitoring the $O_2$ content in flue gas exhausted by the combustion process;

(c) correcting said feedforward signal in response to sensed deviations between the measured $O_2$ content and the target $O_2$ set point.

6. The method of claim 5 wherein said $O_2$ set point is generated as a function of both load and fuel mixture and is calculated as a function of both the theoretical air requirements and the total air requirements for the fuels being burned.

7. The method of claim 1 further comprising:
(a) providing cross-limiting functions for limiting the fuel flow to the available air and for assuring sufficient air for the measured fuel flows including continuously calibrating cross-limiting signals to maintain validity of said cross-limiting functions.

8. A method for controlling the concurrent combustion of multiple fuels, comprising the steps of:
(a) developing a heating rate demand signal indicative of the desired heating rate;
(b) generating a feedforward signal indicative of the air requirements for the fuels being burned, said feedforward signal generated by:
(i) measuring the current fuel flow rates for each of the fuels to generate flow signals;
(ii) scaling said flow signals by factors representing the theoretical air requirements for each of said fuels, summing said signals and dividing said summed signals into a signal representing a measured gross fuel heating rate available from said fuels;
(c) generating an air demand signal by comparing said heating rate demand signal with said measured gross heating rate signal and communicating the larger of said signals to a combustion air controller;
(d) measuring combustion air flow and using said feedforward signal to modify said combustion air flow signal to generate an equivalent air heating rate signal;
(e) comparing said air demand signal with said equivalent heating rate and adjusting said combustion air controller in response to deviations between said signals;
(f) comparing said equivalent heating rate signal with said heating rate demand signal and communicating the lower of said signals to a fuel heating demand development subsystem for adjusting the flow rates of said fuels.

9. The method of claim 8 further including:
(a) generating a target $O_2$ set point that is a function of fuel mix;
(b) measuring the $O_2$ content of flue gas generated by the combustion process; and,
(c) adjusting said feedforward signal in response to deviations between said target $O_2$ set point and the measured $O_2$ content of said flue gas.

10. A control method for concurrently burning multiple fuels having diverse combustion air requirements, comprising the steps of:
(a) generating a heat demand signal;
(b) generating a fuel mix signal indicative of the proportions of high and low grade fuels present in a fuel mixture being burned;
(c) using said fuel mix factor as a feedforward signal to derive a modified air flow signal that is communicated to a combustion air controller that is also a function of measured combustion air flow;
(d) comparing said modified air flow signal with said heating rate demand siqnal and communicating the lower of said signals to a fuel heating demand subsystem for controlling the metering of said fuels;
(e) comparing said heating rate demand signal with a gross fuel heating rate signal derived by measuring said fuel flow rates and scaling resulting signals to produce signals indicative of the heating value of each of said fuels and communicating the higher of said signals to said combustion air controller to define a set point for said controller;
(f) adjusting said controller in response to sensed deviations between said set point signal and said modified air flow signal.

11. The method of claim 10 further including a function generator for generating a target $O_2$ signal as a function of said fuel mix signal and using said signal to modify said feedforward signal to adjust for sensed deviations between said target $O_2$ set point and the measured $O_2$ content of flue gas exhausted by the combustion of said fuels.

12. Apparatus for controlling the combustion of multiple fuels having diverse excess air requirements, comprising:
(a) means for generating a heating rate demand signal;
(b) sensors for monitoring the flow rates of fuels being burned;
(c) scaling means for converting signals received from said sensors to signals representing the heating value per unit time of each of said fuels;
(d) first summing means for summing said signals to arrive at a gross fuel heating rate signal;
(e) other scaling means for converting said sensed signals to signals representing the theoretical air required per unit time for each of said fuels;
(f) other summing means for summing said signals;
(g) means for generating a feedforward signal as a function of the fuel mixture being burned and the heating values of said fuels;
(h) multiplying means for combining said feedforward signal with a signal representing the measured combustion air flow to produce an equivalent air heating rate signal;
(i) a low select comparator for comparing said heating rate signal with said equivalent air heating rate signal, said low select comparator operative to selectively communicate the lower of heating rate demand and equivalent to a fuel demand development subsystem;
(j) a high select comparator for generating an air demand signal for communication to a combustion air controller, said high select comparator operative to select the higher of said heating rate demand signal and said gross heating rate signal; and
(k) continuously recalibrated cross-limiting means for limiting the fuel flow rates to the available combustion air and for assuring sufficient combustion air for the measured fuel flows.

13. The apparatus of claim 12 further including:
(a) an $O_2$ set point generator for generating a target $O_2$;
(b) means for comparing said target $O_2$ with a measured $O_2$ content of flue gas exhausted by the combustion of said fuels;
(c) controller means for modifying said feedforward signal in response to sensed deviations from said target $O_2$ content in said flue gas.

14. The apparatus of claim 13 wherein said set point generator generates an $O_2$ set point which is a function of fuel mix and load.

15. For a combustion process using multiple fuels having diverse air requirements, a method for controlling the air-to-fuel ratio, comprising the steps of:
(a) generating a heat demand signal indicative of the amount of heating required;
(b) measuring the current fuel flow rate for all fuels being burned and generating a fuel heating rate signal indicative of the heating capacity of said fuels;

(c) comparing said heat demand signal with said fuel heating rate signal and communicating the higher of said signals to a combustion air flow controller;
(d) adjusting said air controller in response to said communicated signal;
(e) generating a feedforward signal which is a function of the fuel mixture being burned, and combustion air requirements and heating values of said measured fuels;
(f) measuring the actual air flow;
(g) combining said feedforward signal with said measured air flow ro produce an equivalent air heating rate signal;
(h) comparing said equivalent air heating rate signal with said heat demand signal and communicating the lower of said signals to a fuel flow controller; and,
(i) adjusting the flow of said fuels in response to said communicated lower signal.

16. The method of claim 15 further comprising the steps of:
(a) monitoring $O_2$ content of flue gas exhausted by said combustion process;
(b) generating a target $O_2$ set point which is a function of a fuel mix factor;
(c) adjusting said feedforward signal in response to said monitored $O_2$ content to compensate for errors in calculating said feedforward signal.

17. The method of claim 16 wherein said target $O_2$ set point is a junction of load and said fuel mix factor.

18. The method of claim 17 wherein said $O_2$ set point is approximated by combining two individual functions which relate the $O_2$ set point to load and the $O_2$ set point to the fuel mix factor.

19. For a combustion process using multiple fuels having diverse combustion air requirements, a method for controlling the fuel-to-air ratio, comprising the steps of:
(a) generating a heating rate demand signal indicative of the amount of heating required;
(b) measuring the current fuel flow rate for all fuels being burned and generating a fuel heating rate signal indicative of the heating capacity of said fuels;
(c) comparing said heating rate demand signal with said fuel heating rate signal and communicating the higher of said signals to a combustion air flow controller;
(d) adjusting said air controller in response to said communicated signal;
(e) measuring the actual air flow;
(f) generating a third signal which is a function of the measured air flow and the continuously calculated fuel-to-air ratio signal;
(g) comparing said third signal with said heating rate demand signal and communicating the lower of said signals to a fuel heating rate demand development subsystem;
(h) generation of individual fuel demand signals in the fuel heating rate demand development subsystem;
(i) adjusting the flow of individual fuels in response to their individual demand signals.
(j) generating a theoretical air requirement (fuel mix) factor from measured fuel flows and their theoretical air requirements;
(k) generating a total air requirement factor from measured fuel flows, theoretical air requirements, and excess air requirements which may be calculated as a function of load and/or fuel mixture;
(l) generating a feedforward signal as a total air requirement factor for continuously adjusting the fuel-to-air ratio;
(m) generating a feedforward signal as a theoretical air requirement factor for continuously adjusting the fuel-to-air ratio;
(n) correcting the feedforward fuel-to-air ratio signal by feedback control from flue gas $O_2$ measurements;
(o) generating an $O_2$ set point as a function of load and fuel mixture from the theoretical air requirement and the total air requirement factors for precise coordination with the feedforward adjustment, provided as a total air requirement factor;
(p) generating the $O_2$ set point as a function of fuel mixture and load from the load signal and the theoretical air requirement factor;
(q) continuously calibrated cross-limiting signals for valid cross-limit functions at all instants of time.

* * * * *